US011702904B1

(12) United States Patent
Anton et al.

(10) Patent No.: US 11,702,904 B1
(45) Date of Patent: Jul. 18, 2023

(54) TOE VALVE HAVING INTEGRAL VALVE BODY SUB AND SLEEVE

(71) Applicant: Lonestar Completion Tools, LLC, Brenham, TX (US)

(72) Inventors: Kenneth J. Anton, Brenham, TX (US); Michael J. Harris, Houston, TX (US)

(73) Assignee: Lonestar Completion Tools, LLC, Houston, TX (US)

( * ) Notice: Subject to any disclaimer, the term of this patent is extended or adjusted under 35 U.S.C. 154(b) by 0 days.

(21) Appl. No.: 17/948,140

(22) Filed: Sep. 19, 2022

(51) Int. Cl.
*E21B 34/14* (2006.01)
*E21B 34/10* (2006.01)
*E21B 34/06* (2006.01)

(52) U.S. Cl.
CPC ..... *E21B 34/063* (2013.01); *E21B 34/108* (2013.01); *E21B 2200/06* (2020.05)

(58) Field of Classification Search
CPC .... E21B 2200/06; E21B 34/063; E21B 34/10; E21B 34/102; E21B 34/103; E21B 34/14; E21B 34/12; E21B 34/16; E21B 43/26
See application file for complete search history.

(56) References Cited

U.S. PATENT DOCUMENTS

| | | | |
|---|---|---|---|
| 2,251,977 | A | 8/1941 | Burt |
| 4,515,217 | A | 5/1985 | Stout |
| 4,609,005 | A | 9/1986 | Upchurch |
| 4,896,722 | A | 1/1990 | Upchurch |
| 4,915,168 | A | 4/1990 | Upchurch |
| 5,048,611 | A | 9/1991 | Cochran |
| 5,229,640 | A | 7/1993 | Pak et al. |
| 5,261,486 | A | 11/1993 | Cornette et al. |
| 5,291,947 | A | 3/1994 | Stracke |
| 5,299,640 | A | 4/1994 | Streich et al. |
| 5,819,853 | A | 10/1998 | Patel |
| 6,286,594 | B1 | 9/2001 | French |
| 6,293,342 | B1 | 9/2001 | McGarian et al. |
| 6,333,699 | B1 | 12/2001 | Zierolf |
| 6,333,700 | B1 | 12/2001 | Thomeer et al. |
| 6,359,569 | B2 | 3/2002 | Beck et al. |
| 6,464,008 | B1 | 10/2002 | Roddy et al. |
| 6,759,968 | B2 | 7/2004 | Zierolf |
| 6,789,619 | B2 | 9/2004 | Carlson et al. |

(Continued)

FOREIGN PATENT DOCUMENTS

| | | | |
|---|---|---|---|
| GB | 2420133 | B | 11/2006 |
| WO | 2008/091345 | A1 | 7/2008 |

(Continued)

OTHER PUBLICATIONS

Schlumberger, *KickStart Rupture Disc Valve* (Copyright 2016).

*Primary Examiner* — Kenneth L Thompson
(74) *Attorney, Agent, or Firm* — Keith B. Willhelm

(57) ABSTRACT

Toe valves comprising a bore, a first sub, a second sub, and a housing. The bore extends through the valve. The first sub has separable elements. The separable elements comprise a first sub element and a sleeve element. The first sub element and sleeve element are joined by a relatively weak bridging portion adapted to break in a controlled manner in response to fluid pressure between the first sub element and the sleeve element. They thereby form an integral component comprised of the separable elements. The housing has a port and couples the first sub element and second sub.

39 Claims, 7 Drawing Sheets

(56) References Cited

U.S. PATENT DOCUMENTS 6,826,594 B1 11/2004 Pettersen
6,834,726 B2 12/2004 Giroux et al.
6,915,848 B2 7/2005 Thomeer et al.
6,989,764 B2 1/2006 Thomeer et al.
7,032,675 B2 4/2006 Steele et al.
7,055,598 B2 6/2006 Ross et al.
7,237,611 B2 7/2007 Vincent et al.
7,252,152 B2 8/2007 LoGiudice et al.
7,283,061 B1 10/2007 Snider et al.
7,385,523 B2 6/2008 Thomeer et al.
7,400,263 B2 7/2008 Snider
7,503,398 B2 3/2009 LoGiudice et al.
7,714,741 B2 5/2010 Snider et al.
7,866,402 B2 1/2011 Williamson, Jr.
7,909,095 B2 3/2011 Richards et al.
7,926,573 B2 4/2011 Swan et al.
8,044,820 B2 10/2011 Snider et al.
8,096,363 B2 1/2012 Williamson, Jr.
8,267,178 B1 * 9/2012 Sommers ..... E21B 34/103 166/334.4
8,276,674 B2 10/2012 Lopez de Cardenas et al.
8,286,717 B2 10/2012 Giroux et al.
8,297,358 B2 * 10/2012 Korkmaz ..... E21B 34/14 166/308.1
8,297,367 B2 10/2012 Chen et al.
8,555,960 B2 10/2013 Mailand et al.
8,613,321 B2 * 12/2013 Ravensbergen ... A61K 48/0025 166/308.1
8,695,716 B2 4/2014 Ravensbergen
8,757,265 B1 6/2014 Cuffe et al.
8,863,853 B1 10/2014 Harris et al.
8,915,300 B2 12/2014 Sommers et al.
9,004,180 B2 4/2015 Jackson
9,121,247 B2 9/2015 George et al.
9,121,251 B2 9/2015 Sommers et al.
9,121,252 B2 9/2015 George et al.
9,133,684 B2 9/2015 Hofman et al.
9,476,282 B2 1/2016 Anton et al.
9,273,535 B1 3/2016 George et al.
9,359,864 B2 6/2016 Harris et al.
9,359,865 B2 6/2016 Mailand et al.
RE46,137 E 9/2016 Mailand et al.
9,441,440 B2 9/2016 Hofman et al.
9,441,467 B2 9/2016 Harris et al.
9,458,698 B2 10/2016 Harris et al.
9,500,063 B2 * 11/2016 Greenan ..... E21B 34/14
9,567,832 B2 2/2017 Hofman et al.
9,611,719 B2 4/2017 Hofman et al.
9,650,866 B2 5/2017 George et al.
9,664,008 B2 5/2017 Kippola et al.
9,835,010 B2 12/2017 Anton et al.
9,896,908 B2 2/2018 Harris et al.
9,915,122 B2 3/2018 Hofman et al.
9,976,386 B2 5/2018 Harris et al.
10,030,474 B2 7/2018 Themig et al.
10,066,461 B2 9/2018 Hardesty et al.
10,107,072 B2 10/2018 Harris et al.
10,107,076 B2 10/2018 Muscroft et al.
10,138,725 B2 11/2018 George et al.
10,156,124 B2 * 12/2018 Guzman ..... E21B 34/14
10,174,590 B2 1/2019 Kellner
10,184,308 B2 1/2019 Chauffe et al.
10,253,594 B2 * 4/2019 Wakefield ..... E21B 34/14
10,301,908 B2 * 5/2019 Wakefield ..... E21B 34/10
10,465,478 B2 * 11/2019 Anton ..... E21B 34/103
2001/0054969 A1 12/2001 Thomeer et al.
2002/0121373 A1 9/2002 Patel
2002/0166665 A1 11/2002 Vincent et al.
2003/0056951 A1 3/2003 Kaszuba
2003/0209349 A1 11/2003 Taylor et al.
2005/0072575 A1 4/2005 Yeo et al.
2005/0126787 A1 6/2005 Gomez
2007/0062690 A1 3/2007 Witcher
2007/0272411 A1 11/2007 Lopez de Cardenas et al.
2007/0295275 A1 12/2007 Purkis et al.
2008/0302538 A1 12/2008 Hofman
2009/0044944 A1 2/2009 Murray et al.
2009/0095463 A1 4/2009 Swan et al.
2009/0095486 A1 4/2009 Williamson, Jr.
2009/0223670 A1 9/2009 Snider
2009/0230340 A1 9/2009 Purkis
2009/0308588 A1 12/2009 Howell et al.
2010/0089587 A1 4/2010 Stout
2010/0314106 A1 12/2010 Tubel
2010/0314562 A1 12/2010 Bisset
2011/0100643 A1 5/2011 Themig et al.
2011/0174491 A1 7/2011 Ravensbergen et al.
2011/0248566 A1 10/2011 Purkis
2011/0284214 A1 11/2011 Ayoub et al.
2012/0006562 A1 1/2012 Speer et al.
2012/0037380 A1 2/2012 Arizmendi, Jr. et al.
2012/0085548 A1 4/2012 Fleckenstein et al.
2012/0111574 A1 5/2012 Desranleau et al.
2012/0279723 A1 11/2012 Hofman et al.
2012/0298243 A1 11/2012 Zierolf
2013/0025872 A1 1/2013 Mailand et al.
2013/0056206 A1 3/2013 Jackson et al.
2014/0076578 A1 3/2014 Hofman et al.
2014/0116721 A1 5/2014 Hofman et al.
2014/0251636 A1 9/2014 Hofman et al.
2014/0374096 A1 12/2014 Anton et al.
2015/0184489 A1 7/2015 Resweber
2015/0369040 A1 12/2015 George et al.
2016/0168949 A1 6/2016 Anton et al.
2016/0177667 A1 6/2016 Kellner et al.

FOREIGN PATENT DOCUMENTS

WO 2012/066290 A2 5/2012
WO 2015/088762 A1 6/2015

* cited by examiner

TOE VALVE HAVING INTEGRAL VALVE BODY SUB AND SLEEVE

FIELD OF THE INVENTION

The present invention relates to valves used in oil and gas well drilling operations and, and more particularly, to valves suitable for initiating fracturing and other stimulation operations in an oil and gas well.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then can flow from the porous formation into the well.

In what is perhaps the most basic form of rotary drilling methods, a drill bit is is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

When the drill bit has reached the desired depth, larger diameter pipes, or casing, are placed in the well and cemented in place to prevent the sides of the borehole from caving in. The well may be extended by drilling additional sections and installing large, but somewhat smaller pipes, or liners. The liners also are typically cemented in the bore. The liner may include valves, or it may then be perforated. In either event, openings in the liner are created through which oil can enter the cased well. Production tubing, valves, and other equipment are installed in the well so that the hydrocarbons may flow in a controlled manner from the formation, into the lined well bore, and through the production tubing up to the surface for storage or transport.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at extremely low rates. The industry, therefore, relies on various techniques for improving the well and stimulating production from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation that will allow hydrocarbons to flow more easily from the formation.

Fracturing a formation is accomplished by pumping fluid, most commonly water, into the well at high pressure and flow rates. Proppants, such as grains of sand or ceramic and other types of particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Fracturing typically involves installing a production liner in the portion of the wellbore passing through the hydrocarbon bearing formation. The production liner may incorporate valves, typically sliding sleeve "ball-drop" valves, to divert fluid into the formation. More commonly, however, the production liner does not incorporate valves. Instead, fracturing will be accomplished by "plugging and perfing" the liner.

In a "plug and perf" job, the production liner is made up from standard joints of liner. The liner does not have any openings through its sidewalls, nor does it incorporate frac valves. It is installed in the wellbore, and holes then are punched in the liner walls. The perforations typically are created by so-called "perf" guns that discharge shaped charges through the liner and, if present, adjacent cement. Fluids can be flowed through the perforations into the formation.

A well rarely, if ever, is fractured all at once or in only one location. It typically will be fractured in many different locations or "zones" and in many different stages. Typically, the first zone will be at the bottom or "toe" of the well. To that end, and regardless of whether it incorporates frac valves or will be perforated, a production liner typically includes an "initiator" or "toe" valve. The toe valve is assembled into the liner and is opened to initiate fracturing. Fluid then is pumped into the well and out the toe valve to fracture the formation in the vicinity of the toe valve.

After the initial zone is fractured, pumping is stopped. A plug is installed in the liner at a point above the fractured zone. In a plug and perf job, for example, the liner is perforated in a second zone located above the plug. A ball then is deployed onto the plug. The ball will restrict fluids from flowing through and past the plug. When fluids are injected into the liner, therefore, they will be forced to flow out the perforations and into the second zone. After the second zone is fractured, the process of plugging, perforating, and injecting is repeated until all zones in the well are fractured.

Though not necessarily the only design, one common type of toe valve has a hydraulically actuated sliding sleeve. The toe valve is run into the well with the sleeve in a closed position. In its closed position, the sleeve prevents fluid from flowing out of the liner through the valve ports. Hydraulic pressure may be applied to the sleeve to move it to an open position in which the ports are open and fluid is able to flow out of the liner into the formation.

Such designs are disclosed, for example, in U.S. Pat. No. 9,476,282 to K. Anton et al. and U.S. Pat. No. 10,465,478 to K. Anton et al. The toe valves disclosed therein include a pair of cylindrical primary structural components or "subs."

The subs are coupled together and spaced apart by a cylindrical housing. A sleeve is hydraulically mounted in a radial clearance between the housing and the subs. An aperture is provided in one of the subs or in the sleeve. The aperture allows fluid to flow into a hydraulic chamber above the sleeve. The aperture is normally closed by a pressure device, such as a rupture disc. As pressure increases within the bore, the disc will rupture, and fluid will flow into the chamber. The fluid entering the chamber will drive the sleeve, moving it from its closed to its open position and allowing fluid to flow out of the valve.

Despite such improvements, however, many toe valves fail to perform as intended in the field because of inadequate quality control in the manufacturing process. Toe valves are assembled from a number of parts. The fabrication of all those parts, and the assembly of those parts into a finished toe valve must be controlled carefully to ensure that once assembled the valve will operate as designed. Extra parts not only increase the complexity, but also the cost of fabrication. Moreover, each part creates the risk of a failure event that will have to be addressed with time consuming and costly remediation efforts. In other words, toe valves must be capable of being run into a well and opened in a reliable and predictable manner.

In summary, toe valves must be capable of being run into a well and opened in a reliable and predictable manner. When installed, they must be anchored securely and provide an effective and robust seal so that the plug is capable of diverting frac fluids pumped into the liner at high-pressures and flow rates. They also must be removed quickly, cheaply, and effectively once well operations are completed and they are no longer needed. At the same time, because a well may be fractured in many different zones and require many plugs, it is important that the plugs can be fabricated economically and with precision and are reliably installed and removed.

The statements in this section are intended to provide background information related to the invention disclosed herein. Such information may or may not constitute prior art. It will be appreciated from the foregoing, however, that there remains a need for new and improved toe valves that can be used in well stimulation processes. Such disadvantages and others inherent in the prior art are addressed by various aspects and embodiments of the subject invention.

SUMMARY OF THE INVENTION

The subject invention relates generally to valves suitable for initiating fracturing and other stimulation operations in an oil and gas well and encompasses various embodiments and aspects, some of which are specifically described and illustrated herein. One broad embodiment of the invention provides for toe valves comprising a bore, a first sub, a second sub, and a housing. The bore extends through the valve. The first sub has separable elements. The separable elements comprise a first sub element and a sleeve element. The first sub element and sleeve element are joined by a relatively weak bridging portion adapted to break in a controlled manner in response to fluid pressure between the first sub element and the sleeve element. They thereby form an integral component comprised of the separable elements. The housing has a port and couples the first sub element and second sub.

Other embodiments provide such toe valves where the housing couples the first sub element and the second sub such that an inner end of the first sub element and an inner end of the second sub are spaced apart axially and the housing is spaced radially from the inner end of the first sub element and the inner end of the second sub. The valve comprises a chamber between the first sub element, the sleeve element, and the housing. The sleeve element is mounted in the radial space between the housing and the inner ends of the first sub element and the second sub, is movable from a closed position, in which the sleeve element restricts flow out of the bore through the port, to an open position, in which the sleeve element allows flow out of the bore through the port, is actuatable by fluid pressure in the chamber. The fluid pressure is effective to break the bridging portion and move the sleeve element from its the closed position to its the open position.

Yet other embodiments provide such toe valves where the bridging portion shears generally along an annular plane extending axially between an outer cylindrical surface of the first sub element and an inner cylindrical surface of the sleeve element.

Still other embodiments provide such toe valves where the chamber is pressure sealed by seal elements consisting of a first seal ring between the first sub element and the housing and a second seal ring between the sleeve element and the housing.

Further embodiments provide such toe valves where the sleeve element has a passage in fluid communication with the bore and the chamber and the sleeve element is actuatable by fluid pressure from the bore through the passage.

Other embodiments provide such toe valves where the sleeve element is actuatable by hydraulic pressure.

Yet other embodiments provide such toe valves where the first sub element has a passage in fluid communication with the bore and the chamber, and the sleeve element is actuatable by fluid pressure from the bore through the passage.

Still other embodiments provide such toe valves where the inner end of the first sub element and the inner end of the second sub each comprises a portion of reduced outer diameter, and the housing is spaced radially outward from the portions of reduced outer diameter.

Further embodiments provide such toe valves where the inner end of the first sub element and the inner end of the second sub each comprise a portion of a first reduced outer diameter and a portion of a second reduced outer diameter, and the housing is coupled to the inner end of the first sub element and the inner end of the second sub at the portions of first reduced outer diameter and is spaced radially outward from the portions of second reduced outer diameter.

Other embodiments provide such toe valves where the housing couples the subs by threaded connections.

Yet other embodiments provide such toe valves where the sleeve element comprises a pressure release device disposed in the passage and where the pressure release device is a rupture disc, check valve, or pressure relief valve.

Still other embodiments provide such toe valves where the sleeve element is releasably retained in the open position, where the sleeve element is releasably retained in the open position by a lock ring engaging one of the subs and the sleeve element, and where the sleeve element is releasably retained in the open position by self-locking tapers.

In other aspects and embodiments, the subject invention provides for toe valves comprising a first sub, a bore, a port, and a chamber. The first sub has separable elements. The separable elements comprise a first sub element and a sleeve element. The first sub element and sleeve element are joined by a relatively weak bridging portion adapted to break in a controlled manner. They thereby form an integral component comprised of the separable elements. The chamber is between the first sub element and the sleeve element. The sleeve element is mounted for displacement from a closed position, in which the sleeve element restricts flow out of the bore through the port, to an open position, in which the sleeve element allows flow out of the bore through the port. The sleeve element is actuatable by fluid pressure in the chamber. The fluid pressure is effective to break the bridging portion and move the sleeve element from its the closed position to its the open position.

Other embodiments provide such toe valves where the bridging portion shears generally along an annular plane extending axially between an outer cylindrical surface of the first sub element and an inner cylindrical surface of the sleeve element.

Yet other embodiments provide such toe valves where wherein the chamber is pressure sealed by seal elements consisting of a first seal ring between the first sub element and the housing and a second seal ring between the sleeve element and the housing.

Still other embodiments provide such toe valves where the sleeve element has a passage in fluid communication with a bore through the valve and the chamber, and the sleeve element is actuatable by fluid pressure from the bore through the passage.

Further embodiments provide such toe valves where wherein a radial clearance between the sleeve element and the housing provides fluid communication between the sleeve passage and the chamber.

Other embodiments provide such toe valves where wherein the sleeve element is actuatable by hydraulic pressure.

Yet other embodiments provide such toe valves where the first sub element has a passage in fluid communication with a bore through the valve and the chamber, and the sleeve element is actuatable by fluid pressure from the bore through the passage.

Still other embodiments provide such toe valves where wherein a radial clearance between the first sub element and the housing provides fluid communication between the first sub element passage and the chamber.

Further embodiments provide such toe valves where wherein the first sub element comprises a pressure release device disposed in the passage and where the pressure release device is a rupture disc, check valve, or pressure relief valve.

Other embodiments provide such toe valves where wherein the sleeve element is releasably retained in the open position by a lock ring engaging one of the subs and the sleeve element and where the sleeve element is releasably retained in the open position by self-locking tapers.

In other aspects and embodiments, the subject invention provides methods of performing a well operation. The method comprises providing a line assembly comprising the novel toe valve and increasing fluid pressure in the liner assembly to open the toe valve and discharge fluids from the liner assembly through the toe valve.

In still other aspects and embodiments, the subject invention provides methods of opening a toe valve in a well liner assembly to perform a well operation. The method comprises running the liner assembly into the well with the toe valve. The toe valve comprises a first sub element and a sleeve element joined by a relatively weak bridging portion adapted to break in a controlled manner closed. The sleeve element is in a closed position. Fluid is increased fluid pressure in the liner assembly such that the fluid pressure is effective to break the bridging portion and move the sleeve element from its closed position to an open position.

Other embodiments provide such methods where the bridging portion shears generally along an annular plane extending axially between an outer cylindrical surface of the first sub element and an inner cylindrical surface of the sleeve element.

Yet other embodiments provide such methods where the fluid pressure is hydraulic pressure.

Further embodiments provide such methods where the method further comprises increasing the fluid pressure in the liner assembly such that the fluid pressure is effective to actuate a pressure release device. Fluid then is flowed from the liner assembly through the pressure release device into a chamber between the first sub element and the sleeve element.

Finally, still other aspects and embodiments of the invention provide apparatus and methods having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the disclosure provided herein.

Figure 1:
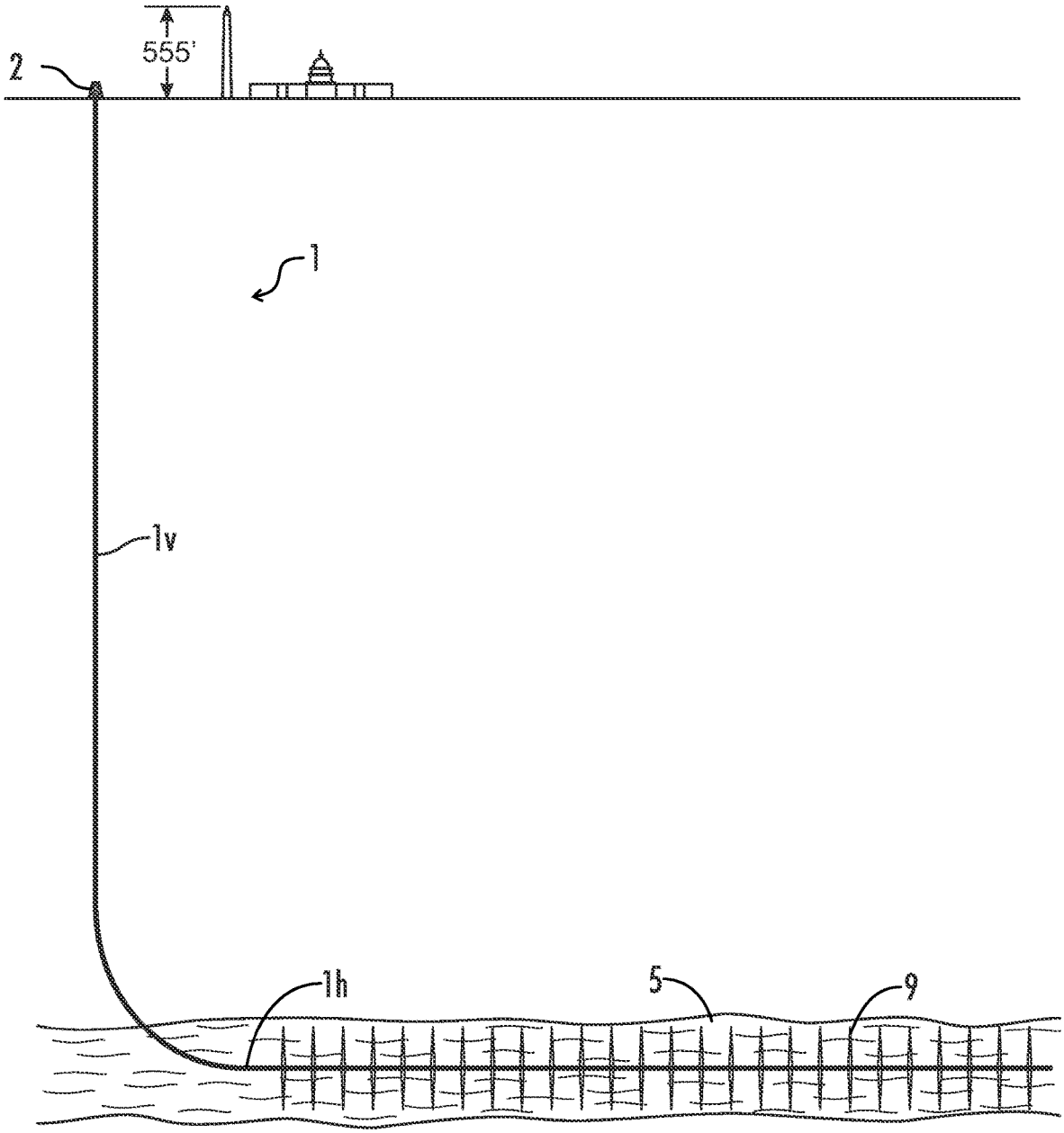
FIG. 1 (prior art) is a schematic depiction in approximate scale of an oil and gas well 1 having a vertical extension 1*v* and a horizontal extension 1*h*.

In the drawings and description that follows, like parts are identified by the same reference numerals. The drawing figures also are not necessarily to scale. Certain features of the embodiments may be shown exaggerated in scale or in somewhat schematic form and some details of conventional design and construction may not be shown in the interest of clarity and conciseness. For example, certain features and components of the embodiments shown in the figures have been omitted to better illustrate the remaining components.

DESCRIPTION OF ILLUSTRATIVE EMBODIMENTS

The subject invention relates generally to toe valves, also referred to as initiator valves, and encompasses various embodiments and aspects. Some of those embodiments are described is some detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The novel toe valves may be used to initiate fracturing operations. They also may be used to initiate other stimulation operations. They may be used with a production liner incorporating frac valves or in fracturing a well by plug and perf operations. Broad embodiments of the novel toe valves have a first sub having separable elements. The separable elements comprise a first sub element and a sleeve element joined by a relatively weak bridging portion. The weak bridging portion is adapted to break in a controlled manner. The separable elements thus form an integral component. The toe valves also have a port and a chamber between the first sub element and the sleeve element. The sleeve element is mounted for displacement from a closed position to an open position. In the closed position the sleeve element restricts flow through the port. In the open position it allows flow through the port. The sleeve element is actuatable by fluid pressure in the chamber. The fluid pressure is effective to break the bridging portion and move the sleeve element from its closed position to its open position

Overview of Fracturing Operations

The complexity and challenges of completing and producing a well perhaps may be appreciated by reference to FIG. 1. FIG. 1 shows a well 1 approximately to scale. Well 1 includes a vertical portion 1*v* and a horizontal portion 1*h*. Schematic representations of the Washington Monument, which is 555 feet tall, and the Capital Building are shown next to a derrick 2 to provide perspective. Well 1 has a vertical depth of approximately 6,000 feet and a horizontal reach of approximately 6,000 feet. Such wells are typical of wells in the Permian Basin, an oil-rich basing located mostly in Texas. Deeper and longer wells, however, are constructed both in the Permian and elsewhere. While neither the vertical portion 1*v* or the horizontal portion 1*h* of well 1 necessarily run true to vertical or horizontal, FIG. 1 provides a general sense of what is involved in oil and gas production. Well 1 is targeting a relatively narrow hydrocarbon-bearing formation 5, and all downhole equipment must be installed and operated far away from the surface.

Figure 2A:
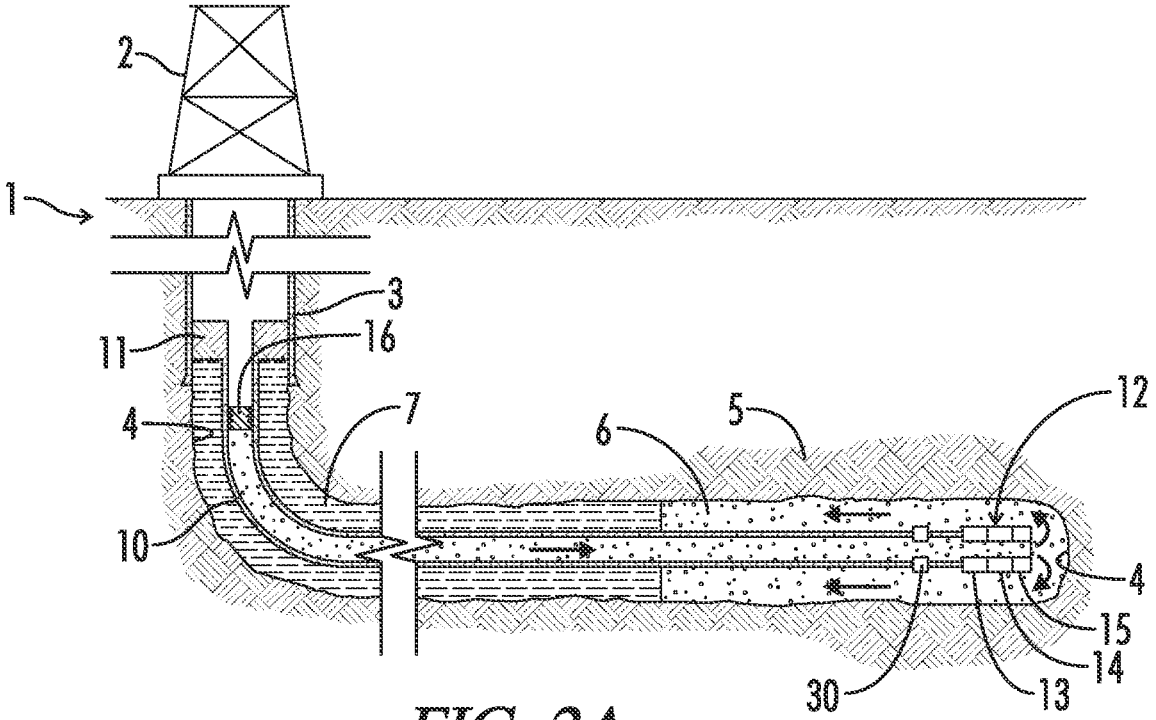
FIG. 2A is a schematic illustration of a liner assembly 10 being cemented in a bore 4 of a well 1, which liner assembly 10 includes a first preferred embodiment 30 of the toe valves of the subject invention.

A first preferred toe or initiator valve 30 will be described by reference to FIGS. 2-6. FIG. 2 illustrate schematically a conventional "plug and perf" job in which the novel toe valves may be used. As may be appreciated therefrom, novel toe valve 30 may be used to initiate a "plug and perf" fracturing operation in an oil and gas well 1. Referring first to FIG. 2A, well 1 is serviced by a derrick 2 and various surface and downhole equipment for pumping cement and circulating fluids (not shown). The upper portion of well 1 is provided with a casing 3, while the lower portion is an open bore 4 extending generally horizontally through a hydrocarbon bearing formation 5.

A liner assembly 10 has been suspended from casing 3 by a liner hanger 11 and extends through open bore 4. Liner assembly 10 includes various tools, including toe valve and a float assembly 12. Float assembly 12 typically includes various tools that assist in running liner 10 into well 1 and cementing it in bore 4, such as a landing collar 13, a float collar 14, and a float shoe 15.

FIG. 2A depicts well 1 as liner 10 is being cemented in bore 4. A quantity or "plug" of cement 6 is being pumped into liner 10, out its lower end, and into the annulus between liner 10 and bore 4. As cement 6 is pumped, it displaces drilling fluids 7 already present in liner 10 and the annulus. A wiper plug 16 is being pumped behind cement 6. It follows the plug of cement 6 as it flows through liner 10. Wiper plug 16 will help clean and remove cement 6 from the inside of liner 10. It will pass through toe valve 30 and eventually seat on landing collar 13 in float assembly 12. Pumping will continue until cement 6 completely fills the annulus between liner 10 and bore 4. It then will be allowed to set, as seen in FIG. 2B.

Figure 2B:
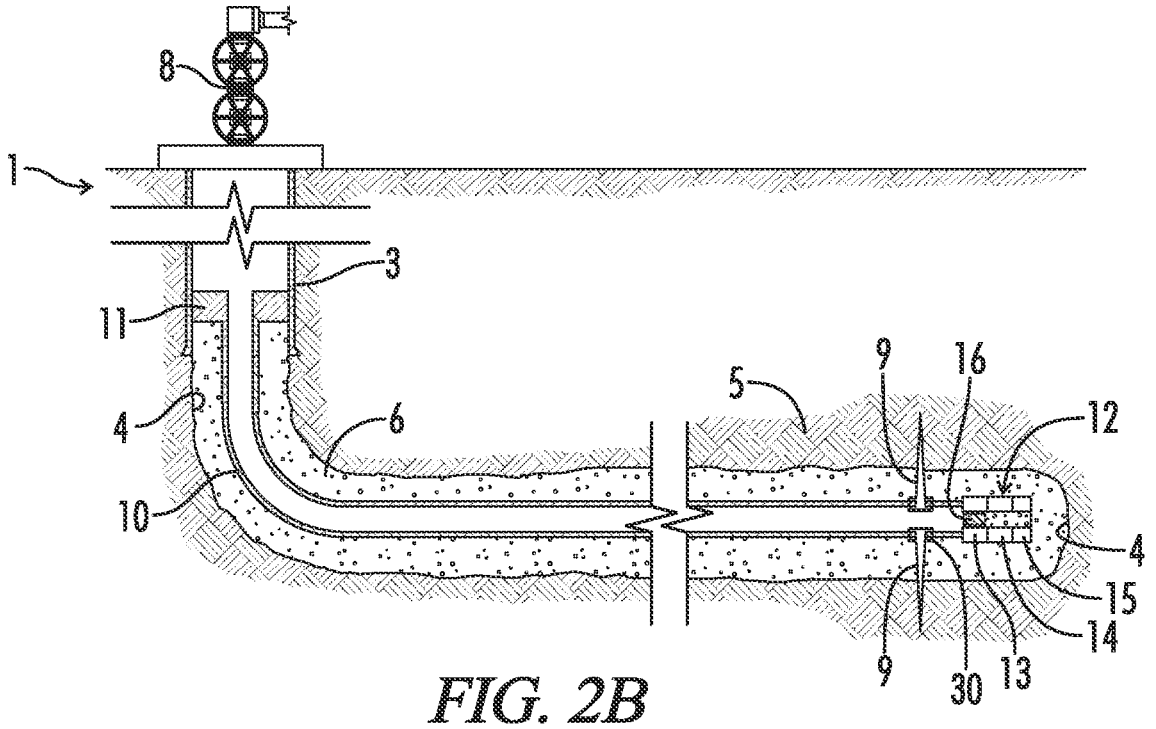
FIG. 2B is a schematic illustration of the initial stage of a "plug and perf" fracturing operation showing liner assembly 10 installed and cemented in wellbore 4 and initial fractures 9 created by opening toe valve 30.

FIG. 2B shows well 1 after the initial stage of a frac job has been completed. Derrick 2 and the cementing equipment have been replaced by well head 8 and other surface equipment (not shown) which will inject frac fluids into well 1 at high pressures and flow rates. Toe valve 30 was run in on liner 10 in its shut position, i.e., with toe valve 30 closed. By means and methods discussed in greater detail below, toe valve 30 now has been opened. Fluid has been pumped through wellhead assembly 8, down liner 10, and forced into formation 5 via open toe valve 30. The fluid has created fractures 9 extending from toe valve 30 into a first zone near the bottom of well 1.

Figure 2C:
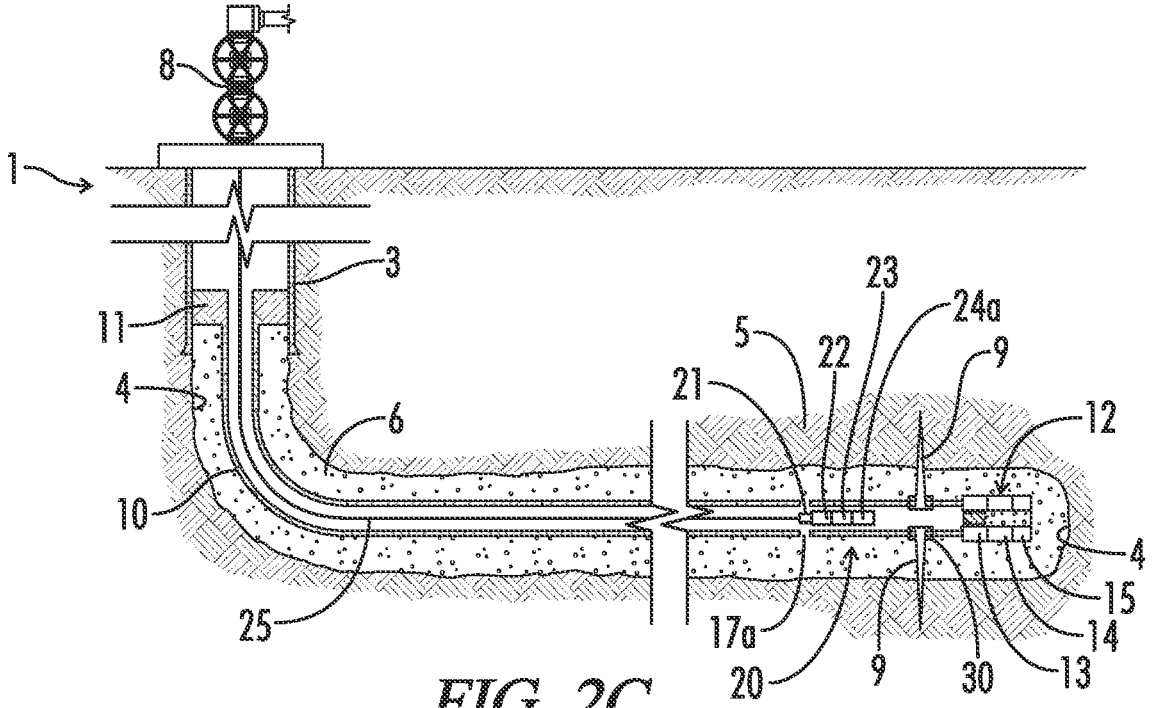
FIG. 2C is a schematic illustration of an early stage of a plug and perf fracturing operation which shows a wireline tool string 20 deployed through a wellhead assembly 8 into a liner assembly 10, where tool string 20 includes a perf gun 21, a setting tool 22, an adaptor 23, and a frac plug 24*a*.
Figure 2D:
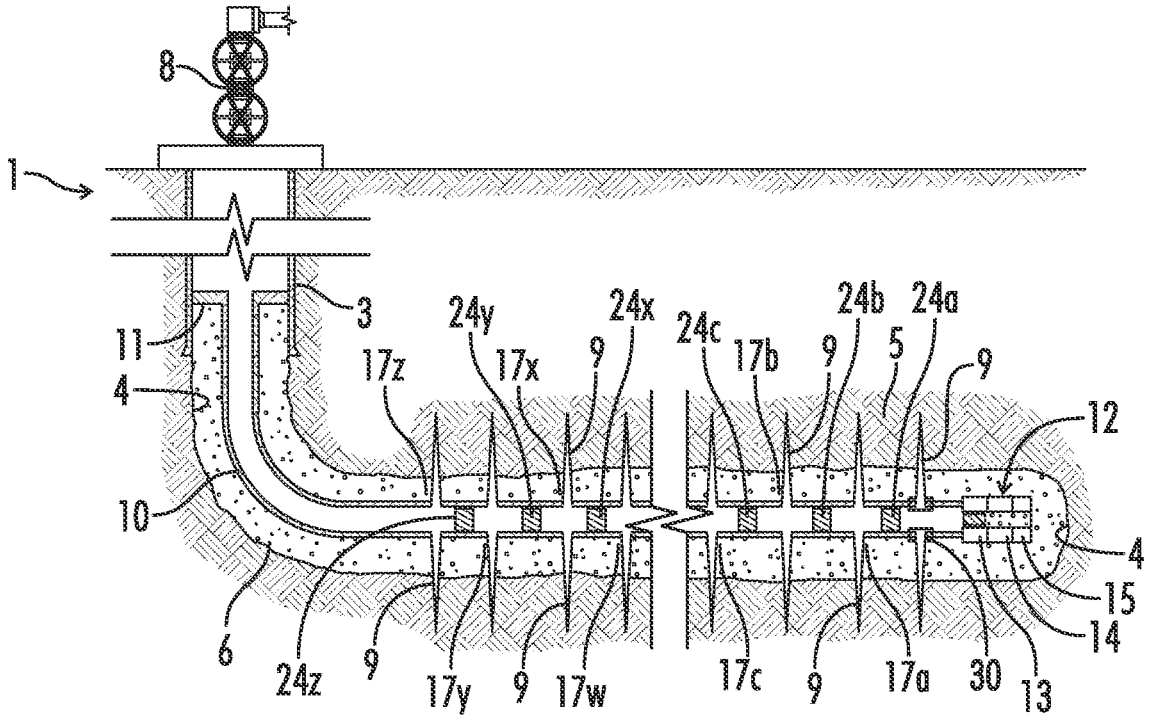
FIG. 2D is a schematic illustration of liner assembly 10 after completion of the plug and perf fracturing operation, but before removal of plugs 24 from liner 10.
Figure 3:
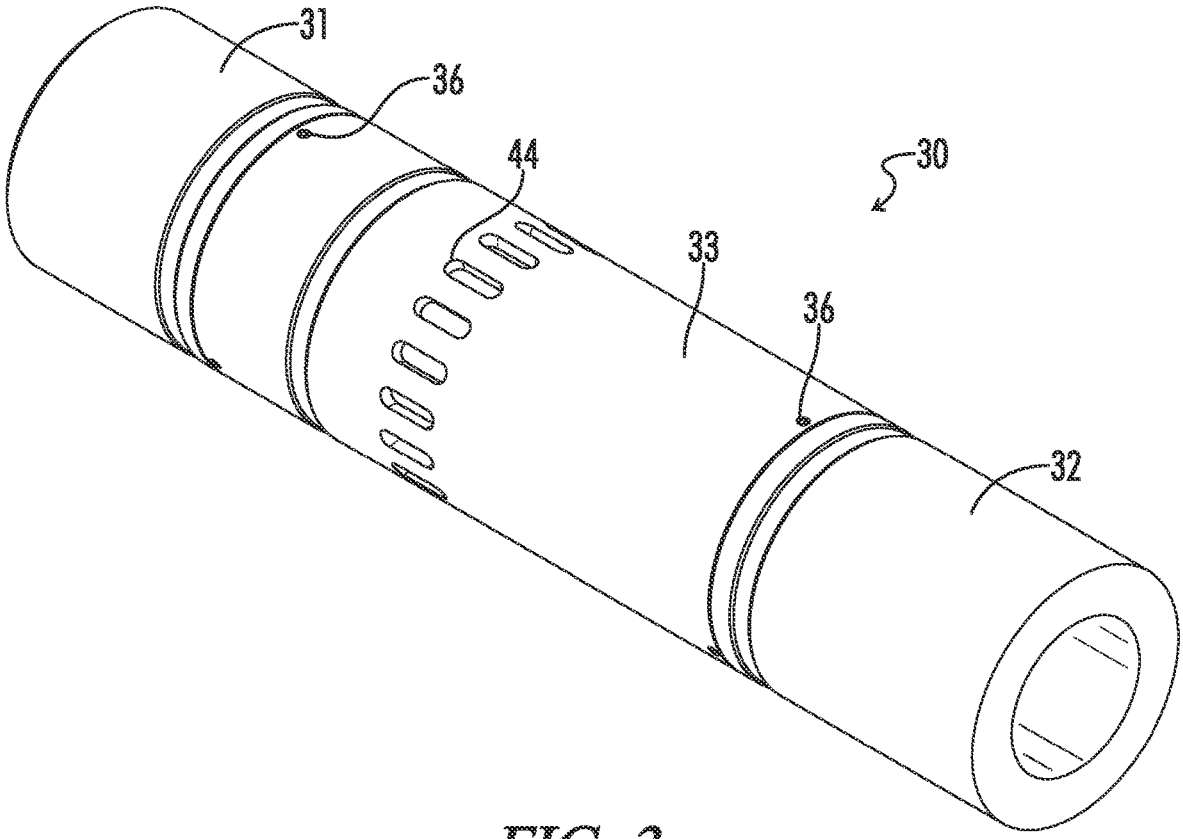
FIG. 3 is an isometric view, taken from above, from the lower end, and to the side of toe valve 30 shown schematically in FIG. 2.

A typical frac job will proceed in stages from the lowermost zone in a well to the uppermost zone. Thus, FIG. 2C shows a "plug and perf" tool string 20 that has been run through wellhead assembly 8 and into liner 10 on a wireline 25. Tool string 20 comprises a perf gun 21, a setting tool 22, a setting tool adaptor 23, and a first frac plug 24*a*. Tool string 20 is positioned in liner 10 such that frac plug 24*a* is uphole from toe valve 30. Frac plug 24*a* is coupled to setting tool 22 by adaptor 23 and will be installed in liner 10 by actuating setting tool 22 via wireline 25. Once plug 24*a* has been installed, setting tool 22 and adaptor 23 will be released from plug 24*a*. Perf gun 21 then will be fired to create perforations 17*a* in liner 10 uphole from plug 24*a*. Perf gun 21, setting tool 22, and adaptor 23 then will be pulled out of well 1 by wireline 25.

A frac ball (not shown) then will be deployed onto plug 24*a* to restrict the downward flow of fluids through plug 24*a*. Plug 24*a*, therefore, will substantially isolate the lower portion of well 1 and the first fractures 9 extending from toe valve 30. Fluid then can be pumped into liner 10 and forced out through perforations 17*a* to create fractures 9 (shown in FIG. 2D) in a second zone. After fractures 9 have been sufficiently developed, pumping is stopped and valves in wellhead assembly 8 will be closed to shut in the well 1. After a period of time, fluid will be allowed to flow out of fractures 9, through liner 10 and casing 3, to the surface.

Additional plugs 24*b* to 24*z* then will be run into well 1 and set, liner 10 will be perforated at perforations 17*b* to 17*z*, and well 1 will be fractured in succession as described above until, as shown in FIG. 2D, all stages of the frac job have been completed and fractures 9 have been established in all zones. Once the fracturing operation has been completed, plugs 24 typically will be removed from liner 10. Production equipment then will be installed in the well and at the surface to control production from well 1.

Overview of First Preferred Toe Valve

As discussed above, the novel toe valves are run into a well in a closed position, but then can be opened to discharge fluid from a liner into a formation to fracture it. Broad embodiments incorporate a valve sub having a sub element that is separable from a sleeve element. For example, consider preferred novel toe valve 30 which is shown in isolation and in greater detail in FIGS. 3-6.

Figure 4:
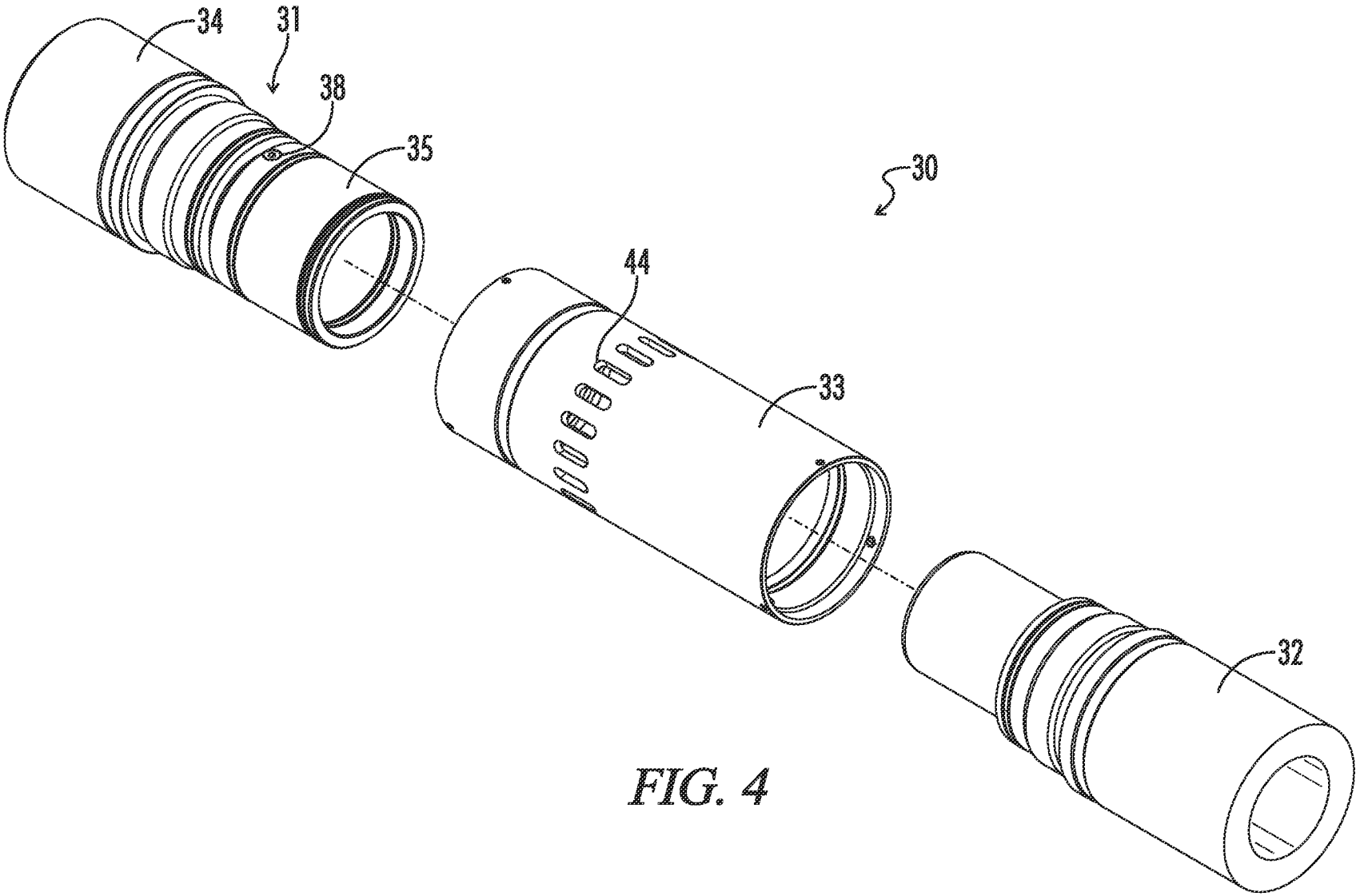
FIG. 4 is an exploded, isometric view, similar to that of FIG. 3, showing the components of toe valve 30.

As best appreciated from FIG. 4, toe valve 30 comprises a top sub 31, a bottom sub 32, and a housing 33. Subs 31 and 32 and housing 33 are the primary structural components of toe valve 30. Subs 31 and 32 have a generally open cylindrical shape, the outer circumference of which is provided with various profiles. Housing 33 has a generally open cylindrical shape with one or more ports 44. Housing 33 and subs 31 and 32 are threaded together or otherwise assembled and may be viewed as forming the body of toe valve 30.

Thus, as may be seen for example in FIGS. 5 and 6, toe valve 30 has a generally open cylindrical configuration with a valve bore 41 that runs along the primary axis of toe valve 30. It also will be noted from that bore 41 of toe valve 30 has a relatively smooth, profile-free inner diameter apart from a tapered enlargement between the inner ends of top sub element 34 and bottom sub 32. Thus, it is expected that a wiper plug, such as wiper plug 16, can more effectively remove cement from toe valve 30 when liner 10 is cemented in well 1.

The top sub of embodiments of the novel toe valves is a unitary or integral component joined by a relatively weak bridging portion. The weak bridging portion is adapted to break in a controlled fashion and allow a sleeve to uncover ports as the toe valve is opened. For example, as seen best in FIG. 5A, top sub 31 comprises a top sub element 34 and a sleeve element 35. Top sub element 34 and sleeve element 35 are joined by a relatively weak bridging portion 31*x*. As described in further detail below, sleeve element 35, in its closed, "run-in" position blocks flow of fluids through ports 44. Sleeve element 35, however, may be broken away from top sub element 34 and then actuated to move from its closed position, to an open, "actuated" position. When sleeve element 35 is in its open position, fluid is able to flow out of valve 30 via ports 44, for example, when fracturing formation 5.

Toe valve 30 is adapted for assembly into liner joints and other tubulars. Top sub 31 and bottom sub 32, therefore, may be provided with conventional features that will allow them to be assembled to tubular joints. For example, the outer ends of sub 31 and 32 may be provided with threads (not shown) which allow them to be assembled into liner 10 by threaded connections. When it is assembled into liner 10, fluids from liner 10 may flow through valve 30 via bore 41, for example, when cementing liner 10 in wellbore 4.

Figure 5A:
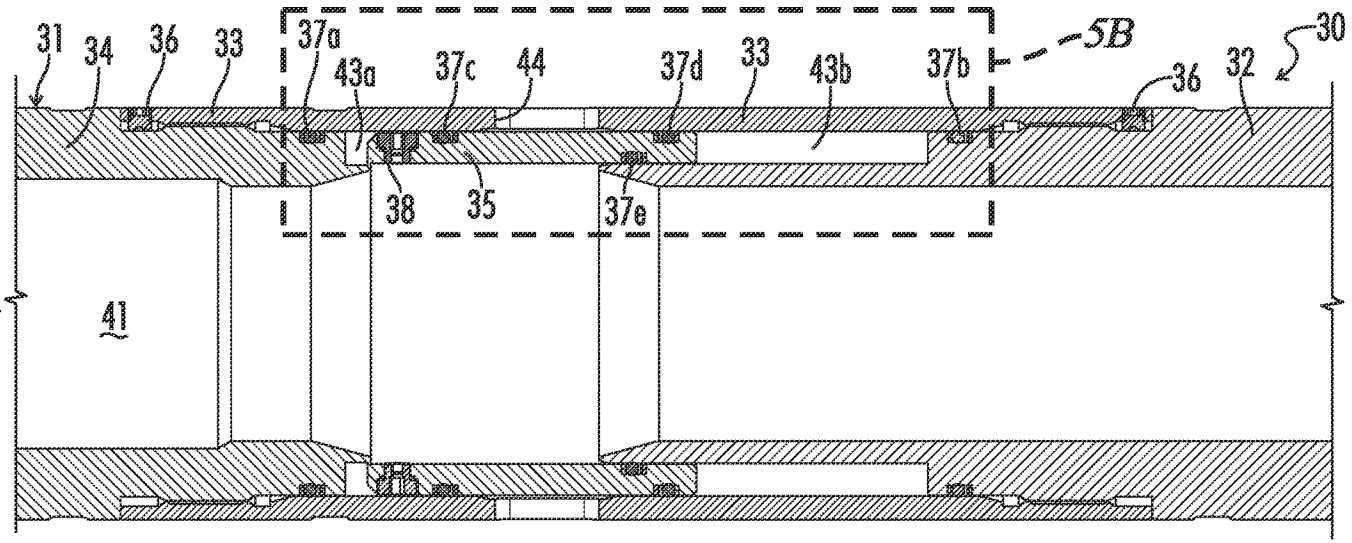
FIGS. 5A and 6A are sequential axial cross-sectional views of toe valve 30 showing, respectively, a middle portion of toe valve 30 in its closed, run-in state (FIG. 5A) and in its open, actuated state (FIG. 6A).
Figure 6A:
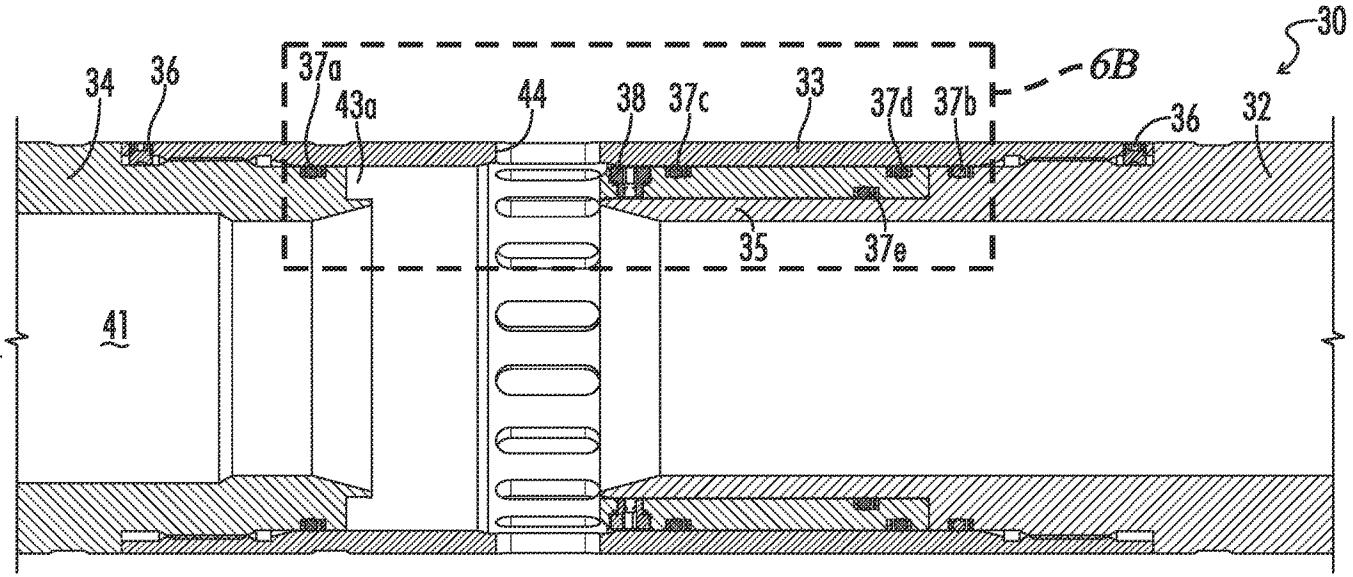

As seen best in FIGS. 4, 5A, and 6A, and to further exemplify the way components of the novel valves may be configured and assembled, it will be appreciated that the outer circumference of top sub 31 and bottom sub 32 are profiled. Top sub element 34 of top sub 31 and bottom sub 32 have first portions in which their outer diameter is reduced relative to the nominal outer diameter of toe valve 30. Those first portions, for example, may be provided with outer threads.

Housing 33 may be provided with internal threads at each of its ends. It then may be threaded at one end to top sub 32 and, more specifically, to top sub element 34, and at the other end to bottom sub 32. The threaded engagement preferably is locked, for example, by set screws 36. Preferably, as shown in FIGS. 5A and 6A, the first portion is reduced in diameter an amount approximately equal to the thickness of housing 33 so that the outer circumference of toe valve 30 will be as uniform as possible. It will be noted that the length of housing 33 is coordinated such top sub element 34 and bottom sub 32 are spaced axially apart from each other. In other words, there is an axial gap between the inner ends of top sub element 34 and bottom sub 32. Ports 44 in housing 33 are generally aligned radially with that gap.

Top sub element 34 of top sub 31 and bottom sub 32 also have second portions in which their outer diameter is reduced relative to their nominal outer diameter and relative to the first portions of reduced outer diameter. Those second portions of reduced outer diameter are situated axially inward from the first portions. Thus, when subs 31 and 32 and housing 33 are assembled, the inner ends of top sub element 34 and bottom sub 32 are radially spaced from, and are generally concentric with the middle portion of housing 33 and ports 44. Subs 31 and 32 and housing 33 thus create an annular clearance or chamber 43 within toe valve 30. Sleeve element 35 extends within chamber 43.

Sleeve element 35 has a generally open cylindrical shape. When it is in its run-in, closed position, as shown in FIGS. 5A and 6A, it extends across ports 44 and across the gap between the inner ends of sub element 34 and sub 32. Fluid is prevented from flowing out of bore 41 through ports 44. Sleeve element 35, when it is in its closed position, also divides chamber 43 into an upper chamber 43*a* and a lower chamber 43*b*.

Upper chamber 43*a* and lower chamber 43*b* preferably are pressure-sealed to preclude the ingress of cement or other fluids as toe valve 30 is run into the well and the well is cemented. Thus, conventional sealing elements, such as O-rings 37, preferably are provided to hydraulically isolate upper and lower chambers 43*a* and 43*b* from the ingress of fluids from bore 41 and from outside of toe valve 30. For example, O-rings 37*a* and 37*b* are mounted in glands provided in the first reduced diameter portions of top sub element 34 and bottom sub 32. O-rings 37*a* and 37*b* hydraulically seal the gap between those components and housing 33. O-rings 37*c* and 37*d* are mounted in glands in the outer circumference of sleeve element 35 and spaced on either side of ports 44. They hydraulically seal the gap between sleeve element 35 and housing 33. O-ring 37*e* is mounted in a gland on the inner circumference of sleeve element 35. It seals the gap between sleeve element 35 and the second reduced diameter portion of bottom sub 32. Preferably, at least one O-ring 37*d* or 37*e* associated with bottom chamber 43*b* will provide a "burp" seal, allowing fluid pressure within chamber 43*b* to escape as toe valve 30 is assembled.

Figure 5B:
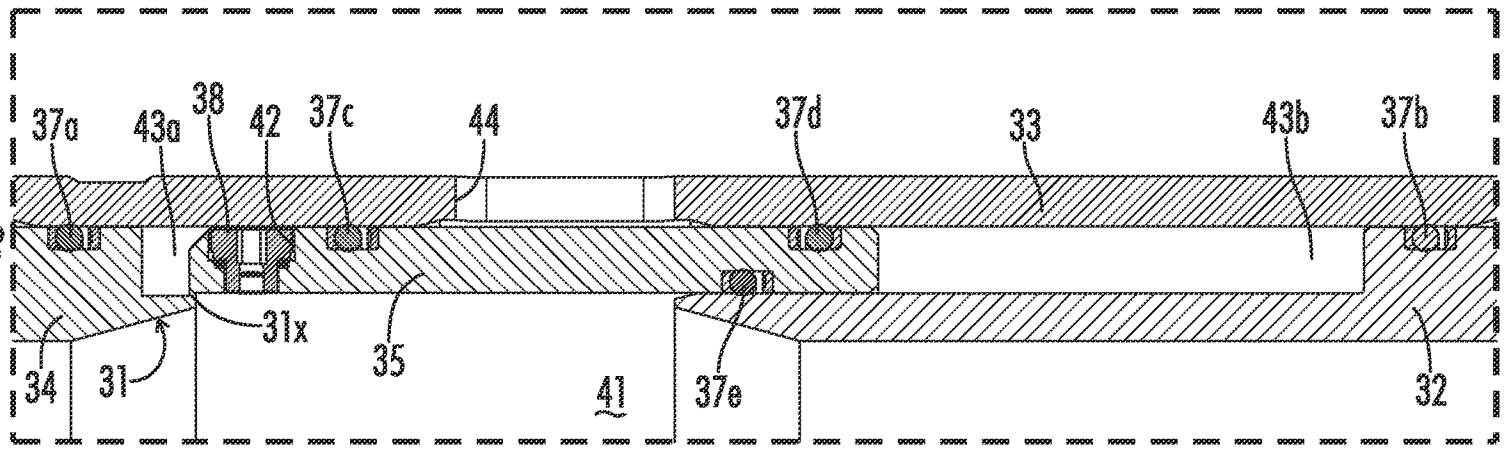
FIGS. 5B and 6B are enlarged views of toe valve 30 taken, respectively, in areas 5B and 6B of FIGS. 5A and 6A.
Figure 6B:
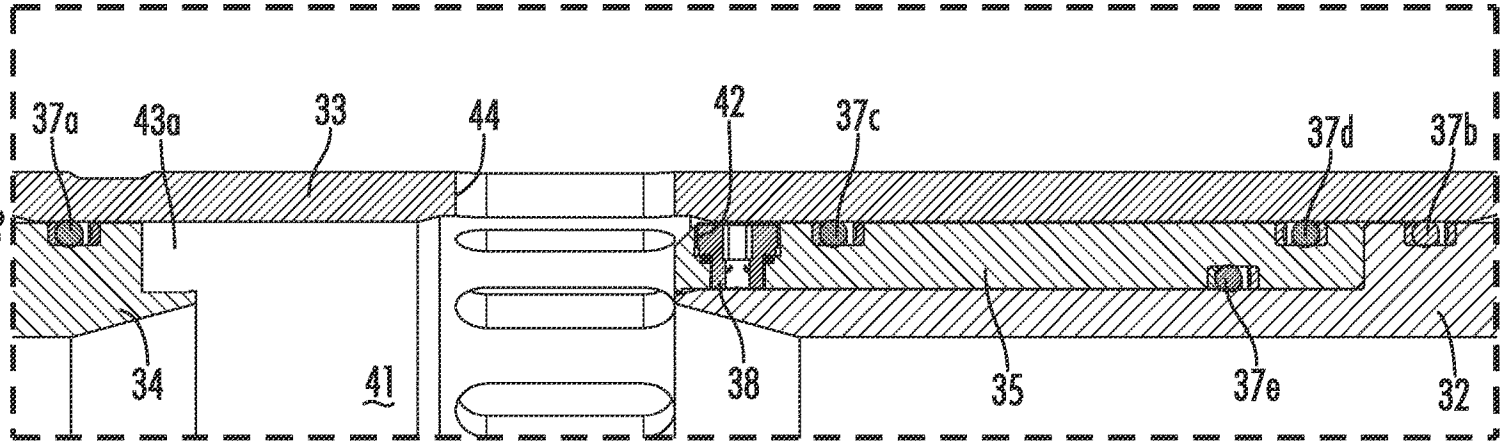

The novel toe valves preferably have a passage that allows actuation of sleeve element 35 by fluid pressure within valve bore 41. For example, sleeve element 35 is provided with apertures 42 as best seen in FIGS. 5B and 6B. Apertures 42 are generally cylindrical holes extending radially through sleeve element 35 and allow fluid communication between bore 41 and upper chamber 43*a*. Toe valve 30 has a pair of apertures 42. It will have at least one, but may have more than two apertures 42 if desired.

The inner terminus, or what may be referred to as the inlet of apertures 42 communicates with bore 41. As best appreciated from FIG. 5B, at their outer terminus or outlet, apertures 42 communicate with upper chamber 43*a* via a radial clearance between the outer surface of sleeve element 35 and the inner surface of housing 33. The clearance is created by a slight reduction in the outer diameter of sleeve element 35, but it may be created by an enlargement in the inner diameter of housing 33 or by other profiles in sleeve element 35 or housing 33. A passage also may extend through sleeve 34 directly to upper chamber 43*a*. Similarly, especially if top chamber 43*a* is lengthened axially, a passage may be provided in top sub element 34 to provide fluid communication between bore 41 and top chamber 43*a*.

The sleeve passages in the novel toe valves preferably are provided with pressure release devices that restrict flow through the passage unless and until pressure within the bore exceeds a predetermined level. For example, apertures 42 preferably are threaded and profiled to accommodate rupture discs 38. Rupture discs 38 provides a rupturable closure which blocks flow through apertures 42 when toe valve 30 is in its closed state.

Rupture discs 38 are mounted in apertures 42, for example, by a threaded connection. Elastomeric seals, seats, or other sealing members (not shown) may be provided to enhance the seal between rupture discs 38 and apertures 42. It will be appreciated, however, that rupture discs 38 may be mounted in a variety of ways such that they block fluid from flowing through apertures 42. Other pressure release devices also may be provided in the sleeve passage, such as check valves and pressure relief valves. In any event, rupture discs or other pressure relief devices allow the novel toe valves to be actuated in response to a predetermined fluid pressure in the valve bore.

For example, as will be appreciated by comparing FIGS. 5B and 6B, hydraulic pressure may be increased within bore 41 to open valve 30. Rupture discs 38, because they are in fluid communication with bore 41, will "see" the same pressure. Both upper chamber 43*a* and lower chamber 43*b* have low internal pressures, at least lower chamber 43*a* preferably being filled only with air captured during assembly of toe valve 30. When the pressure in bore 41 exceeds their rated pressure, as illustrated in FIG. 6B, rupture discs 38 will rupture and allow fluid to flow through apertures 42 and into upper chamber 43*a*.

As fluid enters upper chamber 43*a*, hydraulic pressure will be generated against the upper face of sleeve element 35. As seen best in FIG. 5B, the outer cylindrical surface at the inner end of top sub element 34 that forms part of top chamber 43*a* and the inner cylindrical surface of sleeve element 35 are aligned. Thus, as pressure within top chamber 43*a* increases, bridging portion 31*x* will tend to shear generally along an annular plane extending between those two cylindrical surfaces.

Sleeve element 35 then will be urged downward until its upper end sees the pressure in bore 41. From that point on, hydraulic pressure within bore 41 will bear directly on sleeve element 35 until, as shown in FIGS. 5B and 6B, it has uncovered ports 44 and moved substantially completely into lower chamber 43*b*. Fluid then will be able to exit bore 41 and toe valve 30 via ports 44 to, for example, fracture formation 5 in the vicinity of toe valve 30 as shown schematically in FIG. 1C.

Toe valve 30 has 18 ports arrayed angularly about housing 33, each separated by 20° and each having a generally oval shape. Different numbers of ports 44, however, and different arrays may be employed. Likewise, ports 44 may have other shapes, such as elliptical or circular. The geometries of ports 44 also may vary within a single embodiment. The precise configuration and arrangement of the ports may be varied in ways well known in the art, for example, to provide a desired fracture pattern.

Once opened, ports 44 also will allow hydrocarbons to flow from formation 5 into liner 10 and thence to the surface. Thus, retention mechanisms may be provided to hold sleeve element 35 in its open position so that production is not impeded. For example, toe valve 30 may be provided with a ratchet ring (not shown) mounted within lower chamber 43*b* along the inner diameter of housing 33 or the outer diameter of bottom sub 32. The ratchet ring provides pawls which can engage a series of detents provided on sleeve element 35. The ratchet ring is a split ring, allowing it to compress circumferentially, depressing the pawls and allowing them to pass over the detents on sleeve element 35 as it moves downward in lower chamber 43*b*. The pawls on the ratchet ring are ramped into engagement with the detents, however, if there is any upward travel of sleeve element 35. A variety of such ratchet mechanisms are known, however, and may be used, as may other conventional retention mechanisms. For example, the end of sleeve element 35 may be provided with tapers, and corresponding tapers provided in bottom sub 32 and housing 33 such that sleeve element 35 self-locks into the bottom of lower chamber 43*b*.

The novel toe valves have been exemplified by toe valve 30 and its integral top sub 31. If desired, however, a separable sleeve 35 may be provided on bottom sub 32. Regardless, however, it will be appreciated that the embodiments of the novel toe valves having a sub comprising a sub element joined to a separable sleeve element by a relatively weak bridging portion offer significant advantages over prior art plugs. In particular, they may be assembled from fewer parts, allowing simpler and easier assembly and more reliable actuation.

In novel toe valve 30, for example, O-rings 37*a* and 37*c* allow upper chamber 43*a* to be hydraulically pressurized to actuate sleeve element 35. They also preclude the ingress of fluids into upper chamber 43*a* that potentially can interfere with actuation of sleeve element 35 and opening of toe valve 30. Unlike conventional sliding-sleeve toe valves, such as those discussed above, there is no need for additional seals to allow top chamber 43*a* to be pressurized. Bridging portion 31*x* between top sub element 34 and sleeve element 35 prevents, at least initially, fluid flow from valve bore 41 into top chamber 43*a*.

It also will be appreciated that hydraulic pressure can build within a toe valve and cause the valve to open prematurely. Most typically, that can occur if the seals isolating the actuation chamber fail. Fluid can flood the actuation chamber and cause a sleeve to shift downward, opening the valve prematurely. If the seals fail during cementing, cement can harden through the ports and create a situation that is extremely difficult and costly to remedy.

Thus, prior art toe valves, such as those discussed above, typically are provided with a mechanism by which their sliding sleeve may be held in its closed position. For example, shear screws may be used to lock the sleeve to one of the valve subs or housing. The shear screws are screwed into threaded holes passing through the valves sub or housing and extend into bottomed holes in the outer circumference of the sleeve. The shear screws will shear and release the sleeve when the load on the sleeve exceeds a rated force.

The novel toe valves, however, preferably do not require a separate mechanism to prevent premature opening of the valve as it is run into a well. Bridging portion 31*x* between top sub element 34 and sleeve element 35 may be provided with sufficient shear resistance to prevent unintended opening of toe valve 30. Fabrication and assembly of toe valve 30 is thus simpler and easier.

Preferred toe valve 30 has been disclosed and described as being assembled from a number of separate components. Workers in the art will appreciate that certain of those components and other tool components may be fabricated as separate components, or may be combined and fabricated as a single component if desired. For example, the body of toe valve 30 has been described as assembled from three major components: upper sub 31, lower sub 32 and housing 33. Those components allow toe valve 30 to be easily and reliably assembled. The body, however, may be assembled from fewer components. Housing 33 may be formed integrally with bottom sub 32, albeit with greater difficulty and expense. The components also may be split into separate components. Top sub 31 and bottom sub 32, for example, could be provided with a stock inner part and with an outer part serving as an adaptor to allow the valve to be assembled into a liner assembly with different connections. Other modifications of this type are within the skill of workers in the art and may be made to facilitate fabrication, assembly, or servicing of the valves or to enhance its adaptability in the field.

In general, the novel toe valves may be fabricated from materials typically used in valves of this type. Given the extreme stress and the corrosive and abrasive fluids to which toe valves are exposed, suitable materials will be hard and strong. For example, excepting their seals, the components of novel toe valves may be fabricated from 4130 and 4140 chromoly steel or from somewhat harder, stronger steel such as 4130M7, high end nickel alloys, and stainless steel. The components may be made by any number of conventional techniques, but typically and in large part will be made by forging, extruding, or mold casting a blank part and then machining the required features into the part.

The choice of material also will determine in large part the geometry and other design criteria of the bridging portion joining the sub element and sleeve element. The manner, stress points, and nature of the break in the bridging portion will vary somewhat. While the ultimate goal is to break the bridging portion so that the sleeve element can move independently of the sub element, preferably the break will be a relatively clean, smooth break through the bridging portion. The crystalline structure of most metals is sufficiently complex that the material strength and shear tendencies will be predictable to a great degree. More precise control over shear tendencies also may be obtained by scoring, thinning, perforating the material or in other conventional ways.

Rupture disc 38 preferably is fabricated from metal, such as stainless steel grade 316, Inconel® (nickel alloy 600), Monel® (nickel alloy 400), Hastelloy® C-276, and other steel alloys. Other metals may be used, however, as desired. High tensile strength engineering plastics also may be used, such as polycarbonates and Nylon 6, Nylon 66, and other polyamides, including fiber reinforced polyamides such as Reny polyamide. "Super" engineering plastics, such as polyether ether ketone (PEEK) and polyetherimides such as Ultem® may be particularly suitable.

It will be noted that disc 38 is a forward acting or tension type rupture disc. That is, load is applied to a concave side of disc 38 and the tensile strength of disc 38 determines burst pressure. Flat tension discs may be used, as may be reverse action rupture discs. In reverse action discs pressure is applied against a convex side of the disc, placing the disc under compression. The load strength of the disc determines burst pressure. Disc 38 also, as is typical, may include various scoring patterns to control the way in which the disc ruptures. For example, scores may be used to create one or more hinges such that debris from the disc is not carried along with fluid.

The novel toe valves may be provided with conventional seal rings, such as O-rings, bands, or other elastomeric material. Such elastomeric materials include those commonly employed in downhole tools, such as butyl rubbers, hydrogenated nitrile butadiene rubber (HNBR) and other nitrile rubbers, and fluoropolymer elastomers such as Viton. Similarly, there are many known designs for seal rings that may be employed in the novel toe valves.

As should be apparent from the foregoing discussion, references to "upper," "lower," "upward," "downward," and the like in describing the relative location or orientation of features are made contemplating an installed toe valve. Thus, "upper" and "lower," and variants thereof, would be synonymous with, respectively, "uphole" and "downhole."

The novel valves have been described as being assembled into a liner and, more specifically, a production liner used to fracture a well in various zones along the wellbore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, it is a "casing" that does not extend from the surface. "Tubing" refers to a smaller tubular conduit, usually less than 4.5" in diameter. The novel valves, however, are not limited in their application to liners as that term may be understood in its narrow sense. They may be used to advantage in liners, casings, tubing, and other tubular conduits or "tubulars" as are commonly employed in oil and gas wells.

Likewise, while the exemplified toe valves are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled near a "production" well. Water or other fluids then would be injected into the formation through the stimulation wells to drive hydrocarbons toward the production well. Similarly, while hydraulic fracturing is far more common, wells may be pneumatically fractured, for example, by natural gas or carbon dioxide. The novel toe valves may be used in those operations as well. The novel toe valves may be used in all such stimulation processes where it may be desirable to create and control fluid flow in defined zones through a wellbore. Though hydraulically fracturing a wellbore is a common and important stimulation process, the novel toe valves are not limited thereto.

The novel toe valves also have been exemplified in certain types of cementing operations. There are, however, many different methods and tools for cementing liners. The novel toe valves in general may be adapted for use in any such conventional operations. Moreover, while the novel toe valves are particularly useful when the liner will be cemented in the well, they may be used when the liner has not or will not be cemented, that is, in so-called open hole wells.

While this invention has been disclosed and discussed primarily in terms of specific embodiments thereof, it is not intended to be limited thereto. Other modifications and embodiments will be apparent to the worker in the art.

What is claimed is:

1. A toe valve, said toe valve comprising:

(a) a bore extending axially through said valve;

(b) a first sub:

i) having separable elements, said separable elements:

(1) comprising a first sub element and a sleeve element joined by a relatively weak bridging portion adapted to break in a controlled manner in response to fluid pressure between said first sub element and said sleeve element; and (2) thereby forming an integral component comprised of said separable elements;

(c) a second sub;

(d) a housing, said housing:

i) having a port; and ii) coupling said first sub element and second sub such that an inner end of said first sub element and an inner end of said second sub are spaced apart axially, and said housing is spaced radially from said inner end of said first sub element and said inner end of said second sub; and (e) a chamber between said first sub element, said sleeve element, and said housing;

(f) wherein said sleeve element:

i) is mounted in said radial space between said housing and said inner ends of said first sub element and said second sub;

ii) has a passage in fluid communication with said bore and said chamber;

iii) is movable from a closed position, in which said sleeve element restricts flow out of said bore through said port, to an open position, in which said sleeve element allows flow out of said bore through said port; and iv) is actuatable by fluid pressure in said chamber from said bore and through said passage, said fluid pressure being effective to break said bridging portion and move said sleeve element from its said closed position to its said open position.

2. The toe valve of claim 1, wherein said bridging portion shears generally along an annular plane extending axially between an outer cylindrical surface of said first sub element and an inner cylindrical surface of said sleeve element.

3. The toe valve of claim 1, wherein said chamber is pressure sealed by seal elements consisting of a first seal ring between said first sub element and said housing and a second seal ring between said sleeve element and said housing.

4. The toe valve of claim 1, wherein said sleeve element comprises a pressure release device disposed in said passage.

5. The toe valve of claim 4, wherein said pressure release device is a rupture disc.

6. The toe valve of claim 1, wherein:

(a) said inner end of said first sub element and said inner end of said second sub each comprises a portion of reduced outer diameter; and (b) said housing is spaced radially outward from said portions of reduced outer diameter.

7. The toe valve of claim 6, wherein:

(a) said inner end of said first sub element and said inner end of said second sub each comprise a portion of a first reduced outer diameter and a portion of a second reduced outer diameter; and (b) said housing is coupled to said inner end of said first sub element and said inner end of said second sub at said portions of first reduced outer diameter and is spaced radially outward from said portions of second reduced outer diameter.

8. A method of performing a well operation, said method comprising:

(a) providing a liner assembly comprising the toe valve of claim 1;

(b) increasing fluid pressure in said liner assembly to open said toe valve and discharge fluids from said liner assembly through said toe valve.

9. A toe valve, said toe valve comprising:

(a) a first sub, said first sub:

i) having separable elements, said separable elements:

(1) comprising a first sub element and a sleeve element joined by a relatively weak bridging portion adapted to break in a controlled manner; and (2) thereby forming an integral component comprised of said separable elements;

(b) a bore extending axially through said valve;

(c) a port; and (d) a chamber between said first sub element and said sleeve element;

(e) wherein said sleeve element:

i) has a passage in fluid communication with said bore and said chamber;

ii) is mounted for displacement from a closed position, in which said sleeve element restricts flow out of said bore through said port, to an open position, in which said sleeve element allows flow out of said bore through said port; and iii) is actuatable by fluid pressure in said chamber from said bore and through said passage, said fluid pressure being effective to break said bridging portion and move said sleeve element from its said closed position to its said open position.

10. The toe valve of claim 9, wherein said bridging portion shears generally along an annular plane extending axially between an outer cylindrical surface of said first sub element and an inner cylindrical surface of said sleeve element.

11. The toe valve of claim 9, wherein said chamber is pressure sealed by seal elements consisting of a first seal ring between said first sub element and said housing and a second seal ring between said sleeve element and said housing.

12. The toe valve of claim 9, wherein a radial clearance between said sleeve element and a housing coupling said first sub and a second sub provides fluid communication between said sleeve passage and said chamber.

13. The toe valve of claim 9, wherein said first sub element comprises a pressure release device disposed in said passage.

14. The toe valve of claim 13, wherein said pressure release device is a rupture disc.

15. A method of performing a well operation, said method comprising:

(a) providing a liner assembly comprising the toe valve of claim 9;

(b) increasing fluid pressure in said liner assembly to open said toe valve and discharge fluids from said liner assembly through said toe valve.

16. A method of opening a toe valve in a well liner assembly to perform a well operation, said method comprising:

(a) running said liner assembly into said well with said toe valve, wherein said toe valve:

i) comprises an integral, unitary first sub, said first sub comprising a first sub element and a sleeve element joined by a relatively weak bridging portion adapted to break in a controlled manner; and ii) said sleeve element is in a closed position; and (b) increasing fluid pressure in said liner assembly such that said fluid pressure is effective to actuate a pressure release device;

(c) flowing fluid from said liner assembly through said pressure release device into a chamber between said first sub element and said sleeve element to break said bridging portion and move said sleeve element from its said closed position to an open position.

17. The method of claim 16, wherein said bridging portion shears generally along an annular plane extending axially between an outer cylindrical surface of said first sub element and an inner cylindrical surface of said sleeve element.

18. The method of claim 16, wherein said fluid pressure is hydraulic pressure.

19. A toe valve, said toe valve comprising:

(a) a bore extending axially through said valve;

(b) a first sub:

i) having separable elements, said separable elements:

(1) comprising a first sub element and a sleeve element joined by a relatively weak, annular bridging portion adapted to break in a controlled manner in response to fluid pressure between said first sub element and said sleeve element; and (2) thereby forming an integral component comprised of said separable elements;

(c) a second sub; and (d) a housing, said housing:

i) having a port; and ii) coupling said first sub element and second sub.

20. The toe valve of claim 19, wherein said bridging portion shears generally along an annular plane extending axially between an outer cylindrical surface of said first sub element and an inner cylindrical surface of said sleeve element.

21. The toe valve of claim 19, wherein:

(a) said housing couples said first sub element and said second sub such that an inner end of said first sub element and an inner end of said second sub are spaced apart axially, and said housing is spaced radially from said inner end of said first sub element and said inner end of said second sub; and (b) said valve comprises a chamber between said first sub element, said sleeve element, and said housing; and (c) wherein said sleeve element:

i) is mounted in said radial space between said housing and said inner ends of said first sub element and said second sub;

ii) is movable from a closed position, in which said sleeve element restricts flow out of said bore through said port, to an open position, in which said sleeve element allows flow out of said bore through said port; and iii) is actuatable by fluid pressure in said chamber, said fluid pressure being effective to break said bridging portion and move said sleeve element from its said closed position to its said open position.

22. The toe valve of claim 21, wherein said chamber is pressure sealed by seal elements consisting of a first seal ring between said first sub element and said housing and a second seal ring between said sleeve element and said housing.

23. The toe valve of claim 21, wherein:

(a) said sleeve element has a passage in fluid communication with said bore and said chamber; and (b) said sleeve element is actuatable by fluid pressure from said bore through said passage.

24. The toe valve of claim 23, wherein said sleeve element comprises a pressure release device disposed in said passage.

25. A method of performing a well operation, said method comprising:

(a) providing a liner assembly comprising the toe valve of claim 19; and (b) increasing fluid pressure in said liner assembly to open said toe valve and discharge fluids from said liner assembly through said toe valve.

26. A toe valve, said toe valve comprising:

(a) a bore extending axially through said valve;

(b) a first sub:

i) having separable elements, said separable elements:

(1) comprising a first sub element and a sleeve element joined by a relatively weak bridging portion, wherein said bridging portion is at a distal end of said first sub element and is adapted to break in a controlled manner in response to fluid pressure between said first sub element and said sleeve element; and (2) thereby forming an integral component comprised of said separable elements;

(c) a second sub; and (d) a housing, said housing:

i) having a port; and ii) coupling said first sub element and second sub.

27. The toe valve of claim 26, wherein said bridging portion shears generally along an annular plane extending axially between an outer cylindrical surface of said first sub element and an inner cylindrical surface of said sleeve element.

28. The toe valve of claim 26, wherein:

(a) said housing couples said first sub element and said second sub such that an inner end of said first sub element and an inner end of said second sub are spaced apart axially, and said housing is spaced radially from said inner end of said first sub element and said inner end of said second sub; and (b) said valve comprises a chamber between said first sub element, said sleeve element, and said housing; and (c) wherein said sleeve element:

i) is mounted in said radial space between said housing and said inner ends of said first sub element and said second sub;

ii) is movable from a closed position, in which said sleeve element restricts flow out of said bore through said port, to an open position, in which said sleeve element allows flow out of said bore through said port; and iii) is actuatable by fluid pressure in said chamber, said fluid pressure being effective to break said bridging portion and move said sleeve element from its said closed position to its said open position.

29. The toe valve of claim 28, wherein said chamber is pressure sealed by seal elements consisting of a first seal ring between said first sub element and said housing and a second seal ring between said sleeve element and said housing.

30. The toe valve of claim 28, wherein:

(a) said sleeve element has a passage in fluid communication with said bore and said chamber; and (b) said sleeve element is actuatable by fluid pressure from said bore through said passage.

31. The toe valve of claim 30, wherein said sleeve element comprises a pressure release device disposed in said passage.

32. A method of performing a well operation, said method comprising:

(a) providing a liner assembly comprising the toe valve of claim 26; and (b) increasing fluid pressure in said liner assembly to open said toe valve and discharge fluids from said liner assembly through said toe valve.

33. A toe valve, said toe valve comprising:

(a) a bore extending axially through said valve;

(b) a first sub:

i) having separable elements, said separable elements:

(1) comprising a first sub element and a sleeve element joined by a relatively weak bridging portion adapted to break in a controlled manner in response to fluid pressure between said first sub element and said sleeve element; and (2) thereby forming an integral component comprised of said separable elements wherein said first sub element, said sleeve element, and said relatively weak bridging portion are fabricated from the same material, said material extending continuously through said first sub;

(c) a second sub; and (d) a housing, said housing:

i) having a port; and ii) coupling said first sub element and second sub.

34. The toe valve of claim 33, wherein said bridging portion shears generally along an annular plane extending axially between an outer cylindrical surface of said first sub element and an inner cylindrical surface of said sleeve element.

35. The toe valve of claim 33, wherein:

(a) said housing couples said first sub element and said second sub such that an inner end of said first sub element and an inner end of said second sub are spaced apart axially, and said housing is spaced radially from said inner end of said first sub element and said inner end of said second sub; and (b) said valve comprises a chamber between said first sub element, said sleeve element, and said housing; and (c) wherein said sleeve element:

i) is mounted in said radial space between said housing and said inner ends of said first sub element and said second sub;

ii) is movable from a closed position, in which said sleeve element restricts flow out of said bore through said port, to an open position, in which said sleeve element allows flow out of said bore through said port; and iii) is actuatable by fluid pressure in said chamber, said fluid pressure being effective to break said bridging portion and move said sleeve element from its said closed position to its said open position.

36. The toe valve of claim 35, wherein said chamber is pressure sealed by seal elements consisting of a first seal ring between said first sub element and said housing and a second seal ring between said sleeve element and said housing.

37. The toe valve of claim 35, wherein:

(a) said sleeve element has a passage in fluid communication with said bore and said chamber; and (b) said sleeve element is actuatable by fluid pressure from said bore through said passage.

38. The toe valve of claim 37, wherein said sleeve element comprises a pressure release device disposed in said passage.

39. A method of performing a well operation, said method comprising:

(a) providing a liner assembly comprising the toe valve of claim 33; and (b) increasing fluid pressure in said liner assembly to open said toe valve and discharge fluids from said liner assembly through said toe valve.

* * * * *